US012179083B2

(12) United States Patent
Flowers

(10) Patent No.: US 12,179,083 B2
(45) Date of Patent: Dec. 31, 2024

(54) SHOULDER PAD STORAGE CART

(71) Applicant: TNT Sports Equipment, Mitchell, SD (US)

(72) Inventor: Thomas D. Flowers, Mitchell, SD (US)

(73) Assignee: TNT Sports Equipment, Mitchell, SD (US)

( * ) Notice: Subject to any disclaimer, the term of this patent is extended or adjusted under 35 U.S.C. 154(b) by 0 days.

(21) Appl. No.: 17/934,938

(22) Filed: Sep. 23, 2022

(65) Prior Publication Data

US 2023/0097713 A1 Mar. 30, 2023

Related U.S. Application Data

(63) Continuation-in-part of application No. 29/812,651, filed on Oct. 22, 2021, now Pat. No. Des. 1,000,031.

(60) Provisional application No. 63/249,295, filed on Sep. 28, 2021.

(51) Int. Cl.

| | |
|---|---|
| ***A47F 5/10*** | (2006.01) |
| ***A47F 7/00*** | (2006.01) |
| ***A47F 7/24*** | (2006.01) |
| ***A63B 71/00*** | (2006.01) |

(52) U.S. Cl.

CPC ..... *A63B 71/0036* (2013.01); *A47F 5/108* (2013.01); *A47F 7/0014* (2013.01); *A47F 7/24* (2013.01)

(58) Field of Classification Search

CPC ..... A63B 71/0036; A63B 2071/025; A47F 7/0014; A47F 7/04; A47F 7/0007; A47F 5/108; A47F 7/24; A47F 7/141; A47G 25/1442; A47G 25/145; A47G 25/1464

USPC ..... 211/85.7, 49.1, 60.1, 204, 206, 27, 59.4, 211/24, 51, 184, 10, 205; 280/79.3

See application file for complete search history.

(56) References Cited

U.S. PATENT DOCUMENTS

| | | | | | |
|---|---|---|---|---|---|
| 525,162 | A | * | 8/1894 | Schwartz, Jr. | A47B 57/565 211/27 |
| 832,454 | A | * | 10/1906 | Calbeck | A47F 7/30 211/208 |
| 865,268 | A | * | 9/1907 | Powell | A47F 7/30 211/175 |
| 905,163 | A | * | 12/1908 | Finney et al. | A47F 7/30 211/27 |
| 972,447 | A | * | 10/1910 | Harper | A47F 7/30 211/208 |

(Continued)

OTHER PUBLICATIONS

Jaypro, Shoulder Pad Storage Rack, Achillionsports, retrieved on Oct. 22, 2021. Retrieved from the Internet <URL: https://www.achillionsports.com/jaypro-shoulder-pad-storage-rack.html?cmp=googleproducts&kw=jaypro-shoulder-pad-storage-rack&utm_source=bing&utm_medium=cpc&utm_campaign=PLA&scid=scbplpjaypro-shoulder-pad-storage-rack&sc_intid=jaypro-shoulder-pad-storage-rack>.

(Continued)

*Primary Examiner* — Jennifer E. Novosad

(57) ABSTRACT

A shoulder part cart for storing football shoulder pads. The shoulder pad cart has a flat cart base with multiple upright posts. Each upright has a shoulder support located on the upright. The shoulder support has a flat resting surface where the under side of the shoulder pad rests. The shoulder support is bent to have a slight curve to mirror the slight bend of the shoulder pad allowing the shoulder pad to remain up right. Each shoulder support has a spacer on the front and rear side to keep the shoulder pads. The spacers keep the shoulder pad in its shaped form. The uprights are mounted to the base using a mounting panel and bolts.

12 Claims, 8 Drawing Sheets

(56) References Cited

U.S. PATENT DOCUMENTS 2,187,355 A * 1/1940 MacManus ..... A21B 3/00 211/49.1
2,454,858 A * 11/1948 Burt ..... A47B 61/00 211/49.1
D185,752 S * 7/1959 Harper ..... D6/681.3
2,918,174 A * 12/1959 Tabbi ..... A47G 25/1464 211/49.1
3,021,011 A * 2/1962 Visneski ..... B62B 3/04 211/49.1
3,161,158 A * 12/1964 Lurey ..... A47F 5/0087 108/2
3,223,245 A * 12/1965 Weitzman ..... G07F 9/10 211/4
3,661,268 A * 5/1972 Boley ..... A47G 25/1464 211/49.1
3,692,188 A * 9/1972 Bayne ..... A47G 25/1464 211/49.1
3,700,113 A * 10/1972 Hager ..... A47F 7/04 211/23
3,802,573 A 4/1974 Barnes
3,889,814 A * 6/1975 Rice ..... B62B 3/10 D34/21
4,424,905 A * 1/1984 Keen ..... A47G 25/1464 211/49.1
4,919,278 A * 4/1990 Howen ..... A47J 47/16 211/49.1
4,938,364 A * 7/1990 Stadelman ..... A47F 7/163 211/205
5,188,503 A * 2/1993 Appelberg ..... B65G 69/00 211/49.1
5,370,242 A * 12/1994 Huang ..... A47B 81/068 211/59.4
5,377,849 A 1/1995 Martin
5,495,951 A * 3/1996 Biasini ..... B62B 3/10 211/85.6
5,722,544 A * 3/1998 Williams ..... A47B 87/008 211/186
6,039,228 A * 3/2000 Stein ..... B60R 9/06 224/532
6,073,783 A * 6/2000 Allman ..... D06F 59/02 211/85.3
6,119,873 A * 9/2000 Matthews ..... A47F 5/04 211/49.1
6,182,837 B1 * 2/2001 Crabtree ..... E21B 19/15 206/443
6,216,887 B1 * 4/2001 Soo ..... A47G 25/0671 211/205
6,230,904 B1 * 5/2001 Licari ..... A47F 7/0007 211/49.1
6,270,094 B1 * 8/2001 Campbell ..... B62B 3/006 280/47.35
6,467,780 B1 * 10/2002 Winslow ..... B62B 1/10 280/47.35
6,540,183 B1 * 4/2003 Preuss ..... B62B 3/006 248/129
6,644,484 B1 * 11/2003 Sardis ..... A47F 5/137 211/189
6,669,213 B2 * 12/2003 Woerner ..... B62B 3/002 280/47.35
6,848,586 B1 * 2/2005 Guliner ..... A47B 81/00 211/49.1
D530,876 S * 10/2006 Wyse ..... D34/17
7,185,899 B2 * 3/2007 Thiede ..... A47B 46/00 280/47.35
7,377,396 B2 * 5/2008 Keen ..... A47G 25/1464 211/49.1
8,020,716 B2 * 9/2011 Vitale ..... A47F 5/04 211/205
8,342,544 B1 * 1/2013 Blewett ..... B62B 3/022 211/195
8,371,456 B2 * 2/2013 Scadden ..... F26B 25/185 211/59.4
8,528,754 B2 * 9/2013 Noniewicz ..... B27B 21/00 211/49.1
8,714,369 B2 * 5/2014 Liu ..... A47F 7/30 211/175
8,763,824 B2 * 7/2014 Alcock ..... A47G 25/0664 211/85.3
D820,620 S * 6/2018 McLoud ..... D6/681.1
D988,761 S * 6/2023 Huang ..... D6/681
D1,000,031 S * 9/2023 Flowers ..... D34/12
2005/0067360 A1 * 3/2005 Darvial ..... B65D 85/48 211/41.1
2007/0102383 A1 * 5/2007 Evans ..... A47G 25/0671 211/85.7
2014/0129485 A1 * 5/2014 Fisher ..... A63B 71/0036 211/85.7
2023/0097713 A1 * 3/2023 Flowers ..... A63B 71/0036 211/85.7

OTHER PUBLICATIONS

Blazer, 2-stack Shoulder Pad Rack, Achillionsports, retrieved on Oct. 22, 2021. Retrieved from the Internet <URL: https://www.sportsunlimitedinc.com/blazer-2-stack-shoulder-pad-rack.html?utm_source=adwords&utm_medium=pla&country=US>.

Stackhouse, Shoulder Pad Cart, sportsfacilitiesgroup, retrieved on Oct. 22, 2021. Retrieved from the Internet <URL: https://sportsfacilitiesgroup.com/store/stackhouse-shoulder-pad-cart>.

* cited by examiner

SHOULDER PAD STORAGE CART

FIELD OF THE INVENTION

The present invention relates generally to a cart that stores shoulder pads. More specifically, the present invention is a device that can properly store shoulder pads without ruining the original shape.

BACKGROUND OF THE INVENTION

Contact sports require the players to wear protective equipment such as shoulder pads to limit injuries while playing the sport. For many sports teams such as football, multiple sets of shoulder pads are needed to accommodate each player and are usually stored near where the team plays instead of having each player haul their shoulder pad to and from the game. Due to the large and bulky design of the shoulder pad they cannot just be placed within a locker or easily put into a storage room and require a stacking rack of some form. Many of the carts used today utilize one upwards bar along with a horizontal bar allowing the shoulder pads to be stacked with one upon the other. This design allows the shoulder pads to be conveniently stored however the horizontal bars usually dig into the memory foam of the neck of the shoulder pad, resulting in the shape of the shoulder pad becoming distorted, which could result in inadequate protection while playing. Additionally, while the shoulder pads are stacked on the cart many current carts do not have a method for preventing the straps from the shoulder pads to drag on the floor, resulting in the wheels of the cart getting caught up in the straps, creating an inconvenient situation.

An objective of the present invention is to provide users with a cart, to help properly stack shoulder pads without ruining the shape and form of the shoulder pad. The present invention intends to provide users with a shoulder pad cart that can properly support the pad by mimicking the slope of the shoulder pad. In order to accomplish that, a preferred embodiment of the present invention comprises a plurality of uprights, a cart base, and a plurality of wheels. Further, the cart base ensures that the loose shoulder pad straps will not be run over by the plurality of wheels below. Thus, the present invention is a shoulder pad storage cart that retains the shoulder pad original shape while stored and limits any damage to the shoulder pad during storage.

SUMMARY OF THE INVENTION

The present invention is a cart to help with storing shoulder pads properly. The present invention seeks to provide users with a device that can more prevent the memory foam within the shoulder pad from becoming ruined and limit damage in various areas. In order to accomplish this the present invention comprises a plurality of uprights that allow the shoulder pads to be stored without tilting. Further, the cart base ensures that the loose straps are not run over and damaged by the plurality of wheels. Additionally, the plurality of wheels allows for the present invention to be easily and conveniently pushed and pulled around in various directions. Thus, the present invention is a shoulder pad storage cart that retains the shoulder pad original shape while stored and limits any damage to the shoulder pad during storage.

DETAIL DESCRIPTIONS OF THE INVENTION

All illustrations of the drawings are for the purpose of describing selected versions of the present invention and are not intended to limit the scope of the present invention.

Figure 1:
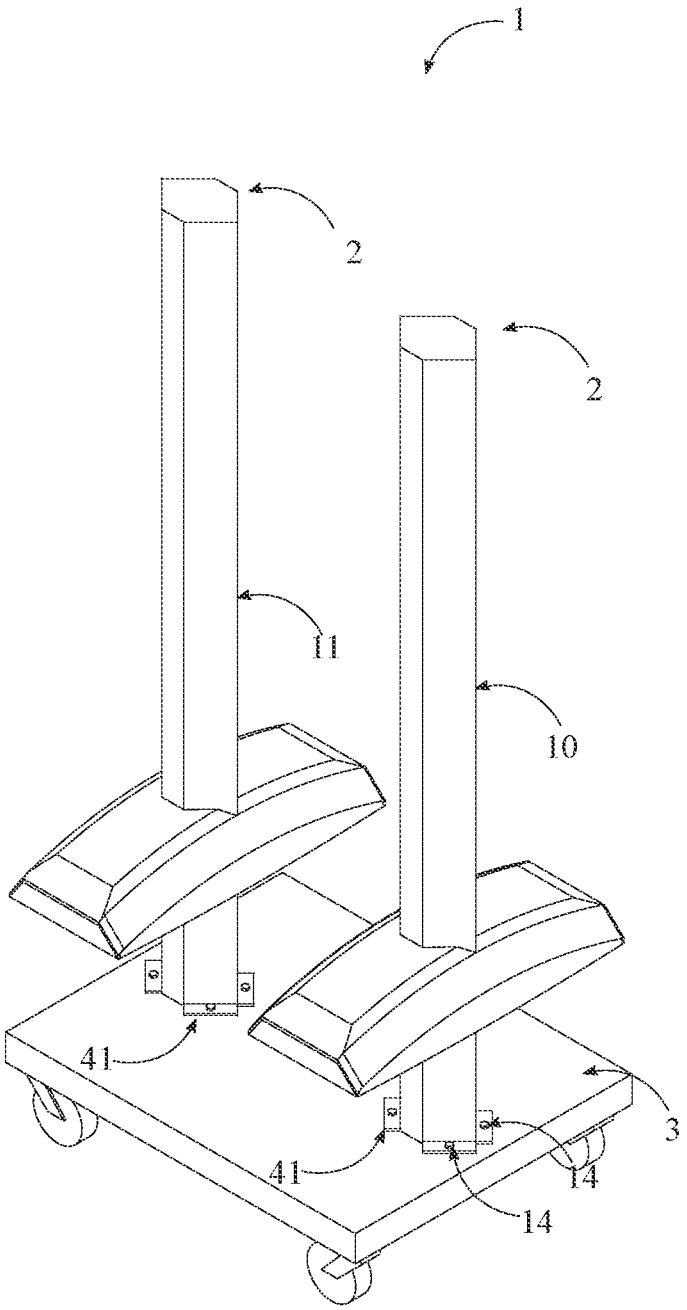
FIG. 1 is a perspective view of the present invention.

As shown in FIG. 1, the present invention is cart 1 that is used to properly store shoulder pads. An objective of the present invention is to provide users with a cart 1 that retains the shape and form of shoulder pads during storage. The present invention intends to provide users with a device that can limit the damage to the shoulder pads during transportation by keeping the shoulder pads in position and ensuring the loose straps are not run over. To accomplish this the present invention comprises a plurality of uprights 2, cart base 3, and plurality of wheels 15. Many of these components allow for the user to properly store and maintain shoulder pads. The plurality of uprights 2 is attached at a 90-degree angle vertically to the cart base 3. Below the cart base 3, a plurality of wheels 15 is attached at each corner, allowing for four independently turning wheels. The plurality of shoulder supports 12 of the plurality of uprights 2 ensures that the slope of the shoulder pad being stored is properly accommodated and will not be moved out of shape. Thus, the present invention is a shoulder pad storage cart that retains the shoulder pad original shape while stored and limits any damage to the shoulder pad during storage.

Figure 7:
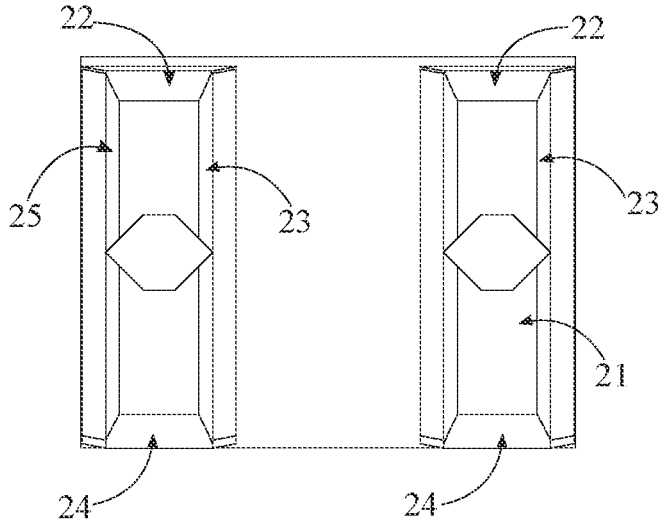
FIG. 7 is a top perspective view of the present invention
Figure 8:
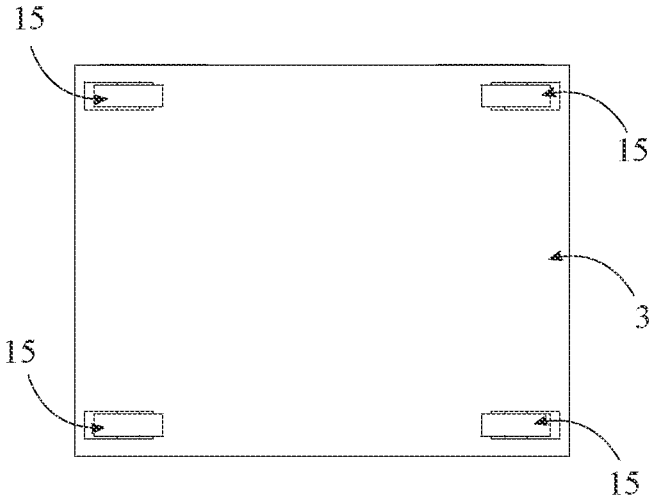
FIG. 8 is a bottom perspective view of the present invention.

The present invention can hold shoulder pads in place with the plurality of uprights 2. The plurality of uprights 2 is made of a lightweight aluminum material with a diamond cross section as shown in FIG. 7. In its preferred embodiment, the plurality of uprights 2 comprise a first upright 10 and a second upright 11. In its preferred embodiment the plurality of uprights 2 comprises a plurality of shoulder supports 12 and a plurality of spacers 13. The plurality of shoulder supports 12 is designed with a similar aluminum material with a curved shape that matches the curvature of the shoulder pads. This design allows for the shoulder pads to rest naturally on the plurality of shoulder supports 12 without having the memory foam or neck shape altered or disfigured. Each of the plurality of shoulder supports 12 comprise a resting surface 21, a first surface 22, a second surface 23, a third surface 24, and a fourth surface 25. The resting surface has a first end 26 and a second end 27. The first surface 22 is positioned between the second surface 23 and fourth surface 25 at the first end 26 of the resting surface 21. The third surface 24 is positioned between the second surface 23 and the fourth surface 25 at the second end 27 of the resting surface 21.

Additionally, to ensure the shoulder pad retains its original shape, the plurality of spacers 13 is positioned at the same height as the plurality of shoulder supports 12. The plurality of spacers 13 is designed with a similar lightweight aluminum material and had a curved rectangular shape. This design of the plurality of spacers 13 allows for the shoulder pads placed on the present invention to stay in a completely upright position to ensure they do not tilt at all. It should be further noted that, the plurality of uprights 2 can be created in various shapes and sizes and the plurality of shoulder supports 12 could be designed with multiple curvatures while still staying within the scope of the present invention. Each of the plurality of spacers 13 has a front spacer 31 and a rear spacer 32. The front spacer 31 is laterally attached to the first surface 22 of each of the plurality of shoulder supports 12. The rear spacer 32 is laterally attached to the third surface 24 of each of the plurality of shoulder supports 12.

The cart base 3 connects to the bottom of the plurality of uprights 2 at a perpendicular angle. The cart base 3 is made with a similar aluminum lightweight material to ensure the present invention is not extremely heavy to move around. In its preferred embodiment the cart base 3 comprises a plurality of bolts 14. Each of the plurality of uprights is mounted to the cart base 3 by way of a plurality of mounting panels 41.

The plurality of mounting panels 41 lay in tandem with the top side of the cart base 3. The plurality of bolts 14 traverse the plurality of mounting panels and the top side of the cart base 3 to ensure the plurality of uprights 2 can be permanently and securely fastened to the cart base 3. The cart base 3 is designed with a rectangular shape and is wide enough to accommodate varying sized shoulder pads. This design of the cart base 3 also ensures that as shoulder pads are stored on the present invention, the loose straps will not hang on the floor with the opportunity for them to get run over, resulting in a damaged strap or a tangle creating an inconvenience for the user.

Figure 2:
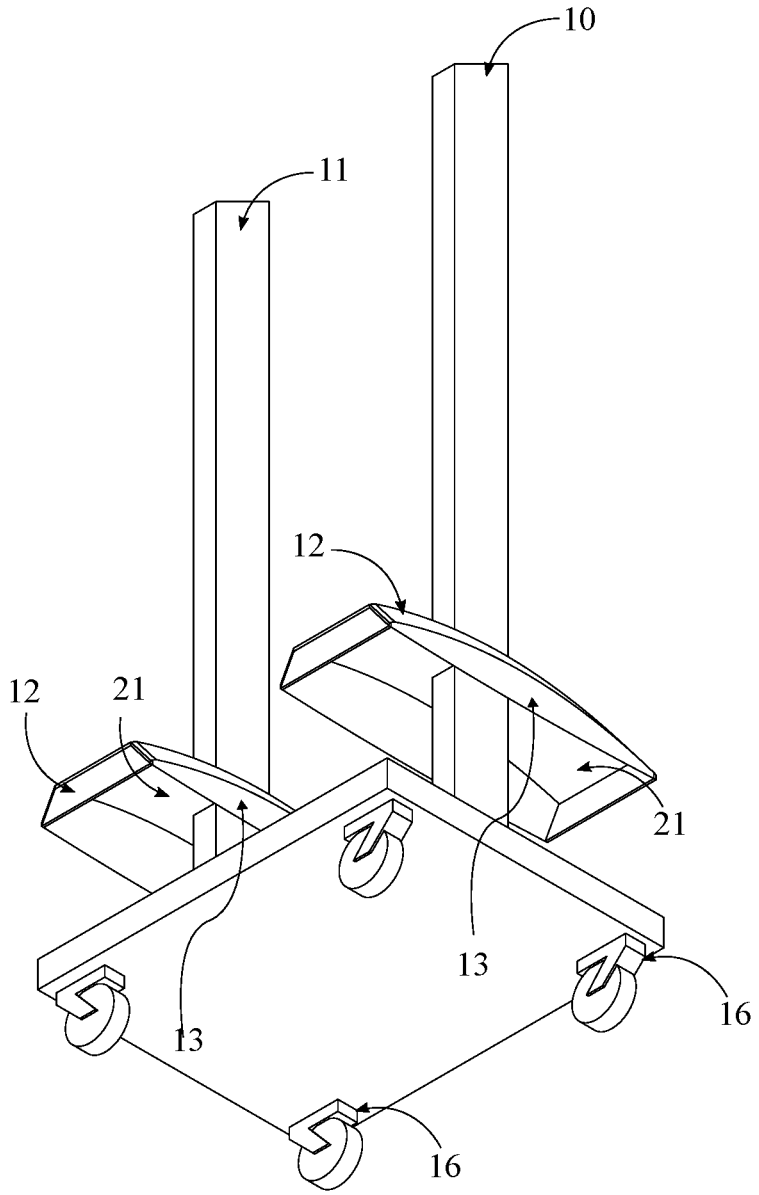
FIG. 2 is a bottom front perspective view of the present invention.
Figure 3:
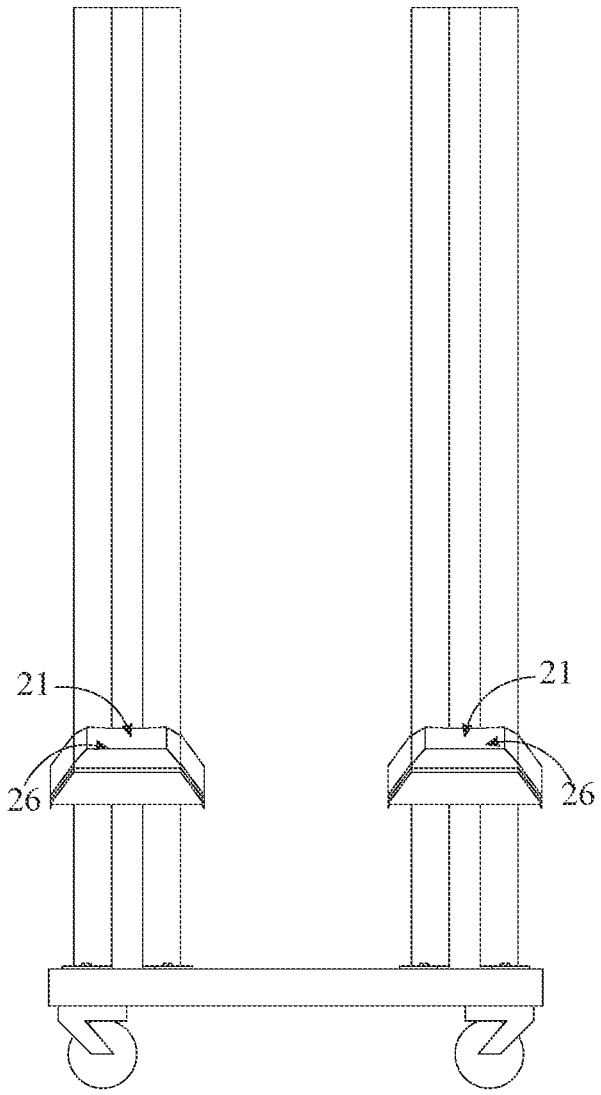
FIG. 3 is a left-side view of the present invention.
Figure 4:
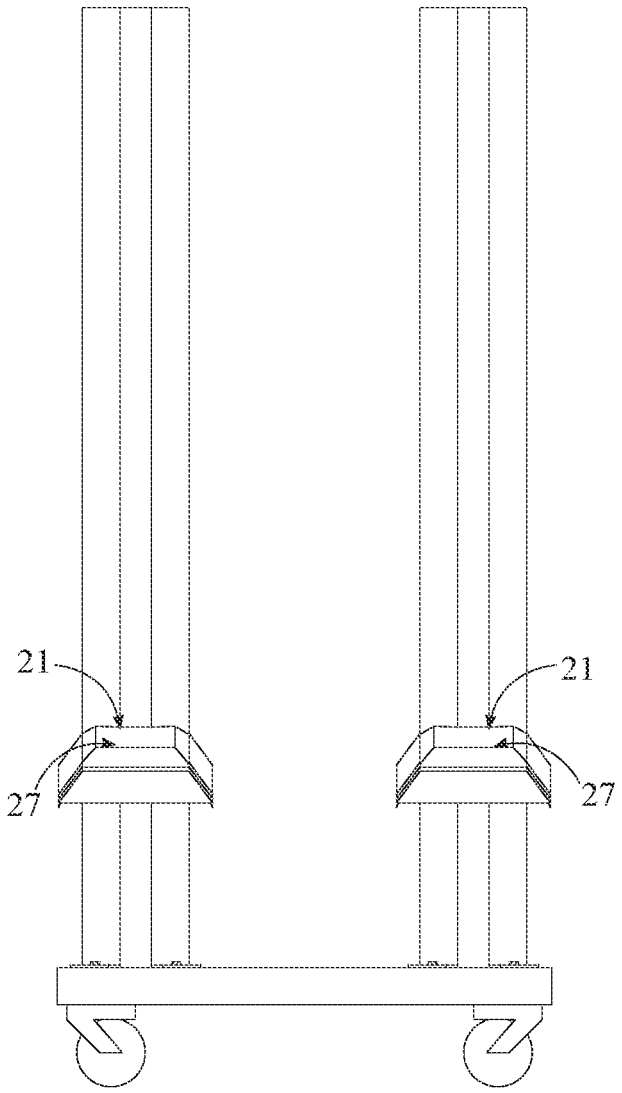
FIG. 4 is a right-side view of the present invention.
Figure 5:
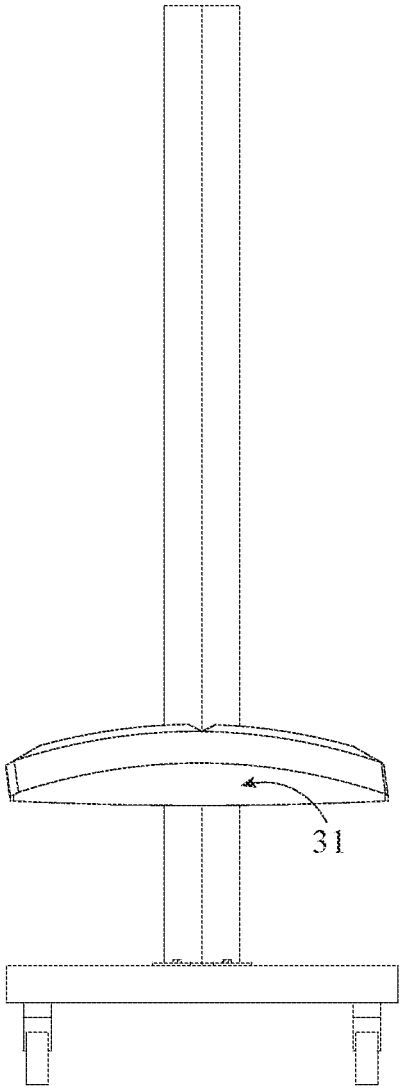
FIG. 5 is a front view of the present invention.
Figure 6:
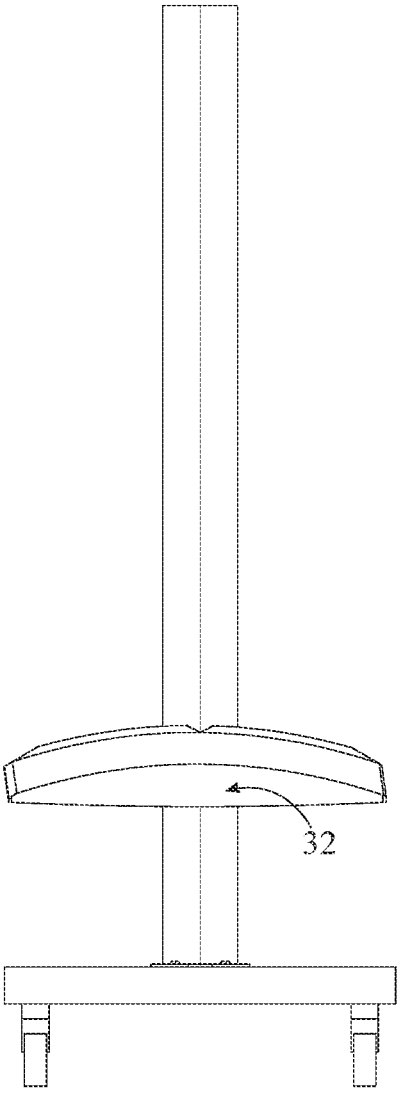
FIG. 6 is a rear view of the present invention

The plurality of wheels 15 attaches to the cart base 3 on the bottom side at each corner as shown in FIG. 2. In its preferred embodiment each of the plurality of wheels 15 comprises a wheel pivot 16. The wheel pivot 16 connects each wheel to the cart base 3 and allows for the wheel to rotate 360 degrees in one position and plane, allowing the plurality of wheels 15 to turn in any direction easily. The plurality of wheels 15 allows for the user to push and pull the present invention easily with each wheel having a full rotational motion. With all the components working in tandem with each other it can be seen that the present invention is a shoulder pad storage cart that retains the shoulder pad original shape while stored and limits any damage to the shoulder pad during storage.

Although the invention has been explained in relation to its preferred embodiment, it is to be understood that many other possible modifications and variations can be made without departing from the spirit and scope of the invention.

What is claimed is:

1. A shoulder pad cart comprising:
a cart base;
a plurality of uprights;
a plurality of wheels; attached to the cart base;
the cart base having a top side and a bottom side;
the cart base having a front end and a rear end;
the cart base having a left side and a right side; and
each of the plurality of uprights being attached vertically to the cart base;
the plurality of uprights comprising a first upright and a second upright;
a plurality of shoulder supports;
each of the plurality of uprights traversing through the center of one of the plurality of shoulder supports;
a plurality of spacers attached to the shoulder supports;
each of the plurality of shoulder supports comprise a resting surface;
the resting surface being parallel with the top side of the cart base;
each of the plurality of shoulder supports comprise a first surface, a second surface, a third surface, and a fourth surface;
the resting surface having a first end and a second end; and
the first surface is positioned between the second surface and fourth surface at the first end of the resting surface; and
the third surface is positioned between the second surface and fourth surface at the second end of the resting surface.

2. The shoulder pad cart as claimed in claim 1 comprising:
the plurality of wheels attached to the bottom side of the cart base;
the plurality of wheels comprising a first wheel, a second wheel, a third wheel, and a fourth wheel;
the cart base having four corners; and
each of the plurality of wheels is positioned at one of the corners.

3. The shoulder pad cart as claimed in claim 1 comprising:
each of the plurality of spacers has a front spacer and a rear spacer;
the front spacer laterally attached to the first surface of each of the plurality of shoulder supports;
the front spacer traversing the length of the first surface of each of the plurality of shoulder supports;
the rear spacer laterally attached to the third surface of each of the plurality of shoulder supports; and
the rear spacer traversing the length of the second surface of each of the plurality of shoulder supports.

4. The shoulder pad cart as claimed in claim 1 comprising:
the cart base comprises a plurality of bolts;
each of the plurality of uprights is mounted to the cart base by way of a plurality of mounting panels;
the plurality of mounting panels lay in tandem with the top side of the cart base; and
the plurality of bolts traverse each of the plurality mounting panels and cart base.

5. The shoulder pad cart as claimed in claim 1 comprising:
each of the plurality of wheels comprises a wheel pivot.

6. A shoulder pad cart comprising:
a cart base;
a plurality of uprights;
a plurality of wheels;
the cart base having a top side and a bottom side;
the cart base having a front end and a rear end;
the cart base having a left side and a right side;
each of the plurality of uprights being attached vertically to the cart base;
the plurality of uprights comprising a first upright and a second upright;
a plurality of shoulder supports;
each of the plurality of uprights traversing through the center of one of the plurality of shoulder supports;
the plurality of wheels attached to the bottom side of the cart base;
the plurality of wheels comprising a first wheel, a second wheel, a third wheel, and a fourth wheel;
each of the plurality of shoulder supports comprises a resting surface;
the resting surface being parallel with the top side of the cart base; and
each of the plurality of shoulder supports comprises a first surface, a second surface, a third surface, and a fourth surface.

7. The shoulder pad cart as claimed in claim 6 comprising:
the cart base having four corners;
each of the plurality of wheels is positioned at one of the corners.

8. The shoulder pad cart as claimed in claim 6 comprising:
a plurality of spacers;
the resting surface having a front end and a rear end; and
the first surface is positioned between the second surface and fourth surface at the front end of the resting surface; and
the third surface is positioned between the second surface and fourth surface at the rear end of the resting surface.

9. The shoulder cart as claimed in claim 8 comprising:
each of the plurality of spacers has a front spacer and a rear spacer;
the front spacer laterally attached to the first surface of each of the plurality of shoulder supports;
the front spacer traversing the length of the first surface of each of the plurality of shoulder supports;
the rear spacer laterally attached to the third surface of each of the plurality of shoulder supports; and
the rear spacer traversing the length of the second surface of each of the plurality of shoulder supports.

10. The shoulder pad cart as claimed in claim 6 comprising:
the cart base comprises a plurality of bolts;
each of the plurality of uprights is mounted to the cart base by way of a plurality of mounting panels;
the plurality of mounting panels lay in tandem with the top side of the cart base;
the plurality of bolts traverse the mounting panel and cart base; and
each of the plurality of wheels comprises a wheel pivot.

11. A shoulder cart pad comprising:
a cart base;
a plurality of uprights;
a plurality of wheels;
the cart base having a top side and a bottom side;
the cart base having a front end and a rear end;
the cart base having a left side and a right side;
each of the plurality of uprights being attached vertically to the cart base;
the plurality of wheels attached to the bottom side of the cart base;
the plurality of wheels comprising a first wheel, a second wheel, a third wheel, and a fourth wheel;
the cart base having four corners;
each of the plurality of wheels is positioned at one of the corners;
the plurality of uprights comprising a first upright and a second upright;
a plurality of shoulder supports;
each of the plurality of uprights traversing through the center of one of the plurality of shoulder supports;
a plurality of spacers;
each of the plurality of shoulder supports comprises a resting surface;
the resting surface being parallel with the top side of the cart base;
each of the plurality of shoulder supports comprises a first surface, a second surface, a third surface, and a fourth surface;
the resting surface having a first end and a second end;
the first surface is positioned between the second surface and fourth surface at the first end of the resting surface;
the third surface is positioned between the second surface and fourth surface at the second end of the resting surface;
each of the plurality of spacers has a front spacer and a rear spacer;
the front spacer laterally attached to the first surface of each of the plurality of shoulder supports;
the front spacer traversing the length of the first surface of each of the plurality of shoulder supports;
the rear spacer laterally attached to the second third surface of each of the plurality of shoulder supports; and
the rear spacer traversing the length of the second surface of each of the plurality of shoulder supports.

12. The shoulder pad cart as claimed in claim 11 comprising:
the cart base comprises a plurality of bolts;
each of the plurality of uprights is mounted to the cart base by way of a plurality of mounting panels;
the plurality of mounting panels lay in tandem with the top side of the cart base; and
the plurality of bolts traverse the mounting panel and cart base.

* * * * *